US005231237A

United States Patent [19]

Cupp

[11] Patent Number: 5,231,237

[45] Date of Patent: Jul. 27, 1993

[54] GUN GRIP ASSEMBLY

[75] Inventor: Carl J. Cupp, Hawaiian Gardens, Calif.

[73] Assignee: Pachmayr Ltd., Monrovia, Calif.

[21] Appl. No.: 927,330

[22] Filed: Aug. 10, 1992

Related U.S. Application Data

[63] Continuation-in-part of Ser. No. 818,163, Jan. 8, 1992, abandoned.

[51] Int. Cl.[5] ..... F41C 23/00

[52] U.S. Cl. ..... 42/71.02

[58] Field of Search ..... 42/71.02

[56] References Cited

U.S. PATENT DOCUMENTS

| | | | |
|---|---|---|---|
| 1,228,506 | 6/1917 | Wesson | 42/71.02 |
| 2,081,438 | 5/1937 | Pomeroy | 42/71.02 |
| 2,308.627 | 1/1943 | Rickenbacher | 42/71.02 |
| 2,903,811 | 9/1959 | Freed | 42/71.02 |
| 3,672,084 | 6/1972 | Pachmayr | 42/71.02 |
| 3,815,270 | 6/1974 | Pachmayr | 42/71.02 |
| 4,043,066 | 8/1977 | Pachmayr et al. | 42/71.02 |
| 4,132,024 | 1/1979 | Pachmayr et al. | 42/71.02 |
| 4,148,149 | 4/1979 | Pachmayr et al. | 42/71.02 |
| 4,242.824 | 1/1981 | Pachmayr et al. | 42/71.02 |
| 4,286,401 | 9/1981 | Pachmayr | 42/71.02 |
| 4,346.530 | 8/1982 | Stewart et al. | 42/71.02 |
| 4,359,833 | 11/1982 | Pachmayr et al. | 42/71.02 |
| 4,378.651 | 4/1983 | Pachmayr et al. | 42/71.02 |
| 4.586.282 | 5/1986 | Sniezak | 42/71.02 |
| 4,638.582 | 1/1987 | Farrar | 42/71.01 |
| 4,658.528 | 4/1987 | Ruger | 42/71.02 |
| 4,771.562 | 9/1988 | Ruger | 42/71.02 |
| 4,878.304 | 11/1989 | Cupp | 42/71.02 |
| 4,936,036 | 6/1990 | Sniezak et al. | 42/71.02 |
| 4,967,503 | 11/1990 | Farrar | 42/71.02 |
| 5,101,589 | 4/1992 | Duncan | 42/71.02 |

OTHER PUBLICATIONS

Disclosure Statement of Patent Application Ser. No. 7/818,163 filed Jan. 8, 1992 on "Gun Grip Assembly" by Carl J. Cupp. The present application is a continuation-in-part of that prior application.

Booklet entitled "Smith & Wesson—Centerfire Pistols—Safety Instructions and Parts Manual".

*Primary Examiner*—David H. Brown

*Attorney, Agent, or Firm*—William P. Green

[57] ABSTRACT

A grip assembly for a hand gun, including two body panels which are received at opposite sides of a handle of the gun, and which may be formed either separately or integrally as a unitary body, with at least one grip element being mountable in fixed position relative to the body panels and relative to the handle. Preferably, the assembly includes both a forward grip unit and a back strap formed at least in part of deformable elastomeric material for cushioning contact of the grip assembly with the user's hand. The forward grip unit may have two side portions to be received at outer sides of the two body panels, with a forward strap extending between and interconnecting the side portions at the front of the handle. The body panels may be connected to the handle by extension of a pin through those panels and through an opening in the handle. The same pin may also extend through an opening in the back strap to secure the body panels, the forward grip unit, and the back strap in fixed relative positions.

36 Claims, 5 Drawing Sheets

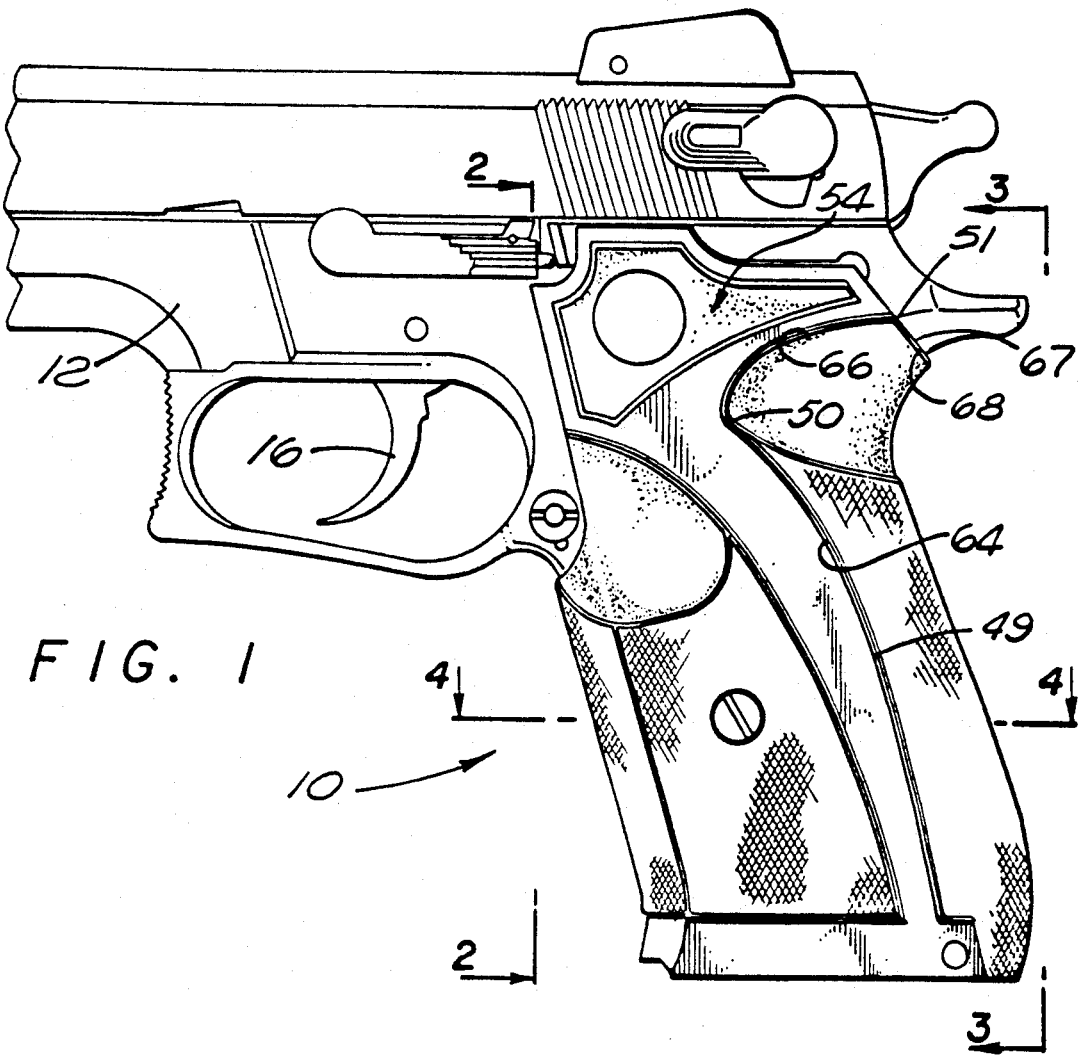
FIG. 1
FIG. 2
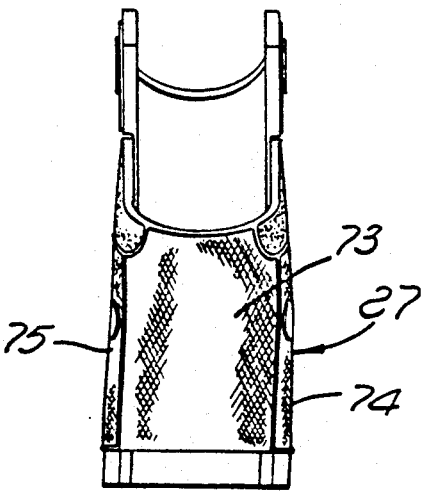
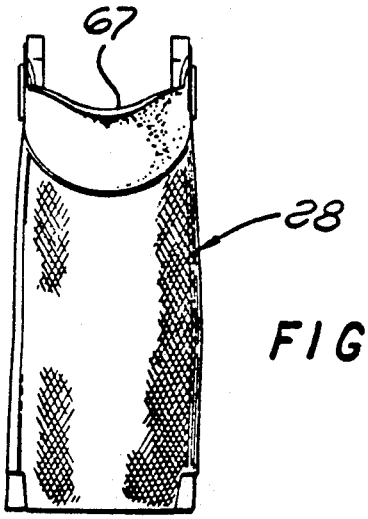
FIG. 3

FIG. 8
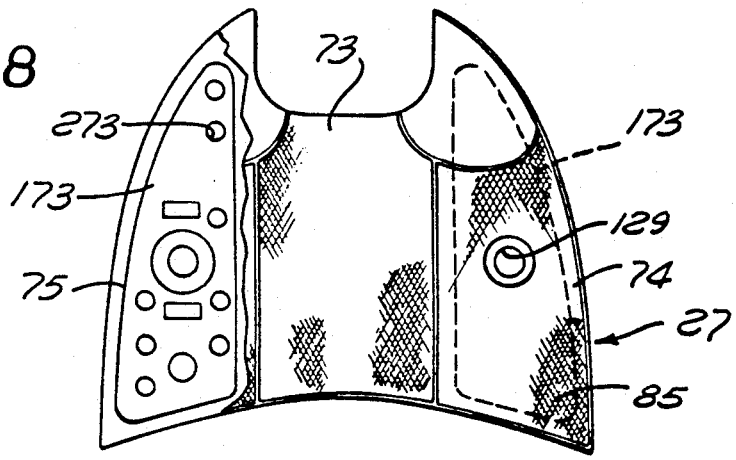
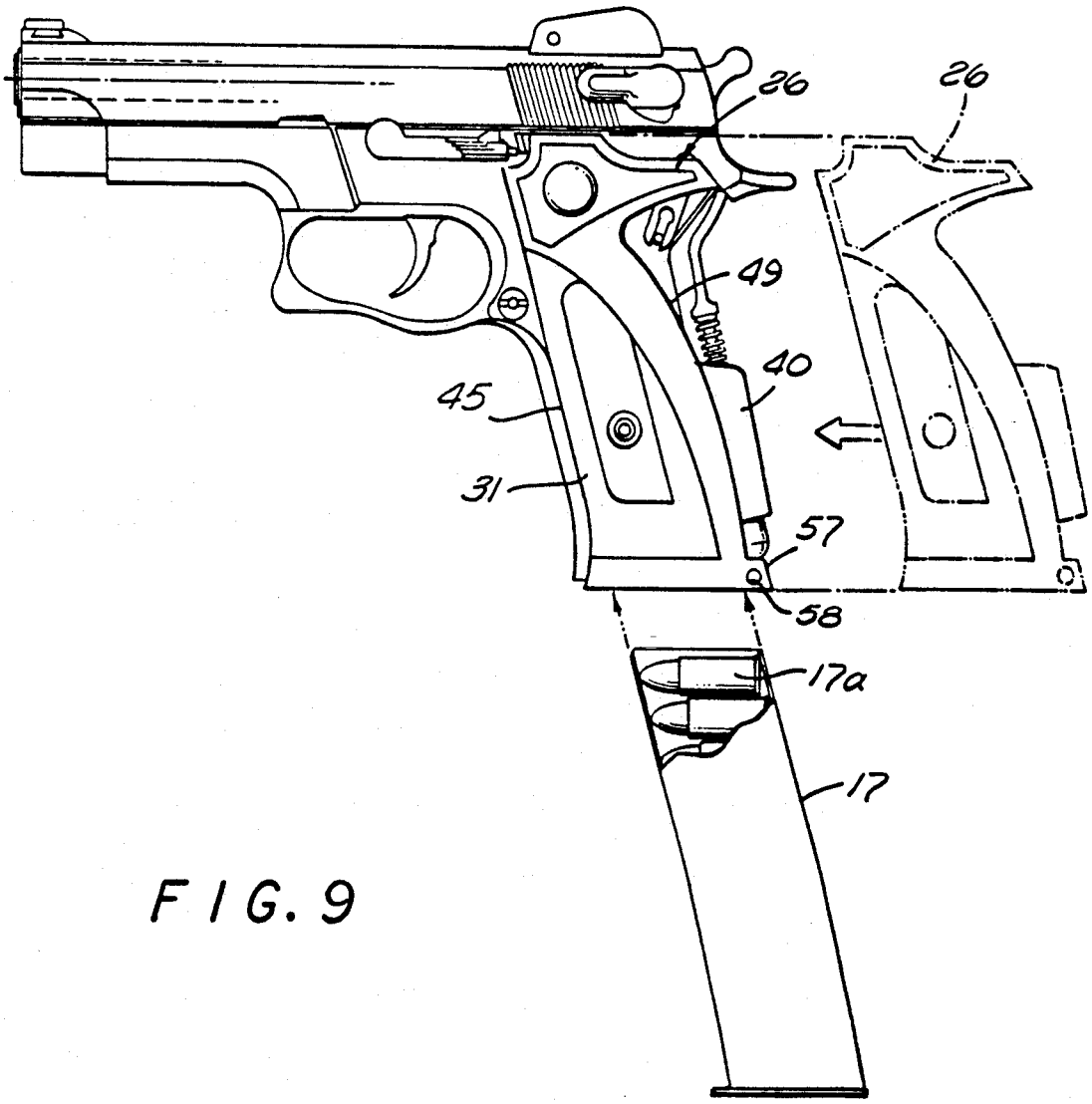
FIG. 9

GUN GRIP ASSEMBLY

This application is a continuation-in-part of U.S. patent application Ser. No. 7/818,163 filed Jan. 8, 1992, now abandoned.

This invention relates to an improved sectionally formed grip assembly for a hand gun.

BACKGROUND OF THE INVENTION

Various different types of grips have been devised in the past for attachment to pistols and other hand guns to enable a user to better hold and aim the gun, or to reduce recoil or otherwise improve the comfort with which the gun is held and fired. Many of the most popular grips have had gripping surfaces formed of an elastomeric material, to be slightly deformable under pressure and thus cushion the contact between the gun and a user's hand. However, some guns currently on the market are so constructed that deformable grips of the previously devised types can not be easily attached to these guns. For example, one such gun is produced with a rigid plastic grip of U-shaped horizontal section which is slipped onto the handle of the gun from the rear, and is then retained in position by a pin extending through registering openings in the grip and in a lower portion of the handle.

SUMMARY OF THE INVENTION

A major purpose of the present invention is to provide a novel type of cushioning grip assembly which can be utilized on guns for which cushioning grips have not previously been available, such as for example the gun discussed above. Further contemplated is a grip which may be more readily adaptable than prior grips to fit the hands or satisfy the desires of different users. To attain this purpose, a grip embodying the invention includes a plurality of parts which contact different portions of a user's hand and which may be contoured and selected to give the overall grip assembly an essentially custom fit on a particular user.

An assembly embodying the invention includes two body panels which are detachably connectable to the handle of a gun, and are received at opposite sides of the handle, and to which a deformable grip part or grip parts for contacting a user's hand may be connected. In one form of the invention, the two body panels are joined together integrally by a connector strap extending between the panels. In another arrangement, the two body panels are formed separately as two individual elements.

The hand contacting grip parts desirably include two grip panels received at outer sides of the two body panels respectively, and connectible thereto as by screws extending through the grip panels and into the body panels. The two grip panels may be interconnected at their forward ends by a cross strap extending between and joining together the two panels. A second hand contacting grip part may take the form of a back strap which extends across the back of the gun handle, and which may engage the body panels in a relation retaining them against separation from the gun handle. To further assist in securing the body panels and back strap to the handle of the gun, the body panels may contain openings for receiving opposite ends of a retaining pin which also extends through aligned openings in the handle of the gun and in the back strap to locate all of these parts relative to one another.

BRIEF DESCRIPTION OF THE DRAWINGS

The above and other features and objects of the invention will be better understood from the following detailed description of the typical embodiments illustrated in the accompanying drawings, in which:

FIG. 1 is a side view of an automatic pistol provided with a first form of grip assembly constructed in accordance with the invention.

FIGS. 2 and 3 are front and rear elevational views of the grip assembly of FIG. 1 taken on lines 2—2 and 3—3 respectively of FIG. 1;

FIG. 8 is an elevational view showing the forward grip element in open or flat form as it may appear prior to attachment to the gun;

FIG. 9 is a side elevational view of the gun as it appears with only the main body of the grip assembly of FIG. 1 attached;

DESCRIPTION OF THE PREFERRED EMBODIMENTS

Figure 5:
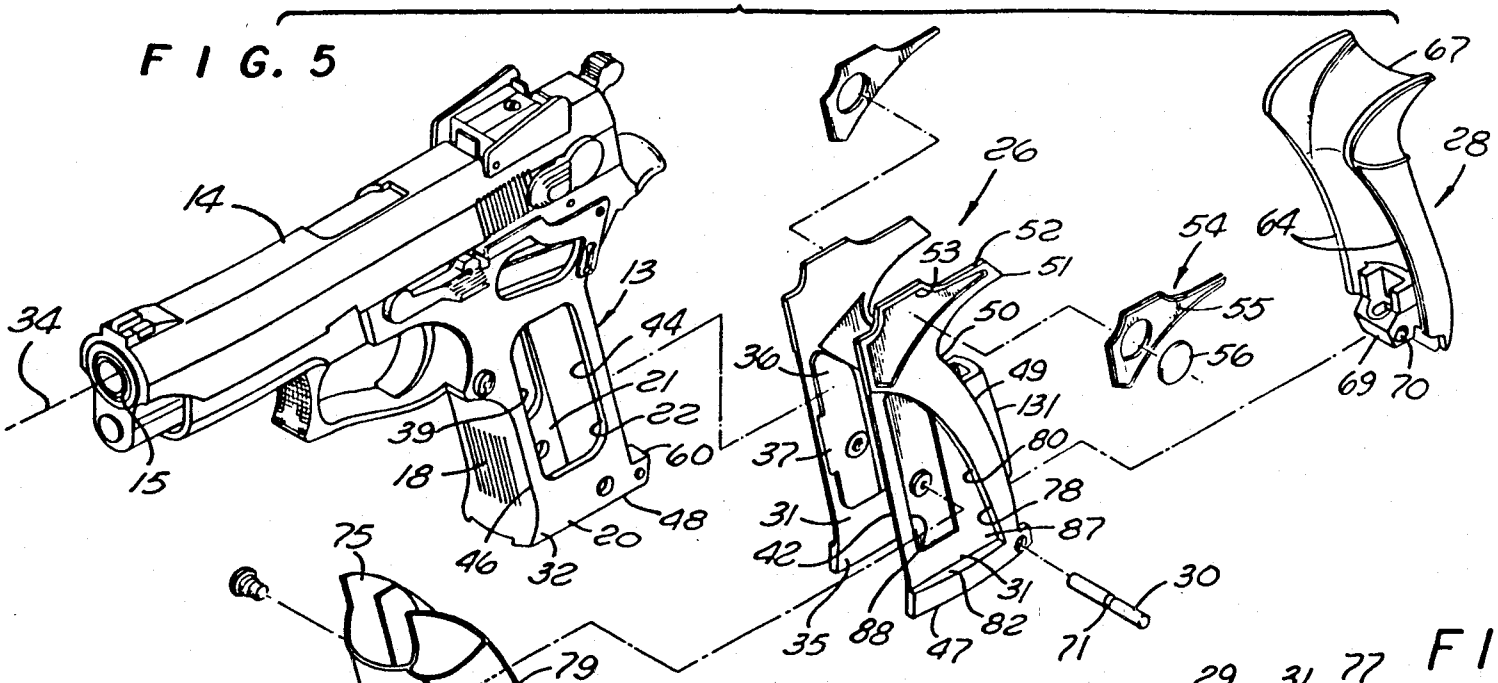
FIG. 5 is an exploded perspective view showing the various parts of the grip assembly.

Referring first to FIG. 1, a first form of grip assembly 10 embodying the invention is shown attached to an automatic pistol of conventional construction, typically of a type manufactured by Smith & Wesson of Springfield, Mass. The gun has a frame 12 with a handle portion 13 (FIG. 5) projecting downwardly therefrom, and with the frame carrying a slide 14 which moves rearwardly relative to the barrel 15 upon firing of the gun by actuation of trigger 16. Handle 13 is hollow and open at its lower end for insertion upwardly into the handle of a conventional magazine 17 containing a series of rounds 17*a* which are successively advanced upwardly to firing position in the gun. Handle 13 is essentially rectangular in horizontal section, having generally parallel slightly inclined front and rear walls 18 and 19, and parallel vertically opposite side walls 20 and 21, with these side walls containing similar side openings 22 shaped essentially as parallelograms.

The main spring 23 of the gun is located behind rear wall 19, and acts to urge stirrup 24 upwardly to actuate the hammer 25. The lower end of spring 23 is received within a hollow plunger 125, which is closed and rounded at its bottom to bear against a portion of the grip assembly in a manner to be discussed at a later point.

The grip assembly 10 of FIGS. 1 to 9 includes a main body or chassis 26 (see FIG. 5) and two grip elements 27 and 28 having outer surfaces formed of neoprene rubber or other resiliently deformable elastomeric material for providing cushioned contact with a user's hand in holding and firing the gun. Element 27 is a forward grip unit attachable to body 26 by two screws 29. The second grip element 28 is a back strap attachable to body 26 and handle 13 of the gun by a transverse retaining pin 30.

Body 26 is preferably molded of an essentially rigid but slightly resiliently deformable plastic material, such as the plastic alloy sold by General Electric under the trade name Zenoy 6380. This body is shaped to have two essentially parallel vertically extending side plates or panels 31 which are received adjacent and fit closely against the outer surfaces 32 of handle 13 of the pistol. Surfaces 32 are planar and extend vertically and parallel to one another and parallel to and at opposite sides of the main central vertical plane 33 of the gun containing axis 34 of barrel 15. At their inner sides, the side panels 31 of body 26 have planar vertical inner surfaces 35 which in the assembled condition of the grip bear against the opposite side surfaces 32 of the gun handle. Projecting inwardly from and beyond surfaces 35, side panels 31 of body 26 have portions 36 which project inwardly a short distance into openings 22 in side walls 20 of the gun handle. A portion of the front edge of each of the projections 36 is shaped to form a thin flange 37 spaced a short distance inwardly of the plane of surface 35 of that side panel 31 of body 26, to define a vertically extending groove 38 within which vertical edge 39 formed by the corresponding side wall 20 or 21 of the gun handle is receivable in the relation illustrated in FIG. 4. During attachment of body 26 to the handle of the gun, side panels 31 of the body are moved forwardly relative to handle 13, so that flanges 37 move into interfitting relationship with portions 39 of the side walls of the gun handle to retain those portions 39 within grooves 38 and thereby hold the side panels 31 of body 26 against movement laterally away from proper engagement with the gun handle.

At the back of the gun handle, side panels 31 of body 26 of the grip assembly are integrally connected together by a rear cross piece or connector portion 131 of the molded body 26. This connector portion 131 preferably extends between only the lower portions of side panels 31, and may have the horizontal sectional configuration illustrated in FIG. 4, to provide a central approximately rectangular portion 40 extending about the back of spring 23. Extending laterally from portion 40, the connector portion 131 may include two generally vertical but slightly forwardly inclined wall sections 41 merging integrally with the rear edges of side panels 31 of the body. Connector portion 131, like the rest of body 26, is essentially rigid and stiff, but is thin enough to allow some lateral movement of side panels 31 toward and away from one another, just enough to permit projections 36 to spread slightly apart as body 26 is moved forwardly onto gun handle 13 from a position such as that illustrated in broken lines in FIG. 9. To enable removal of body 26 from the gun handle when desired, projections 36 at the inner sides of panels 31 of body 26 are provided with camming surfaces 42, each of which advances gradually at an angle from the plane of an inner vertical planar surface 43 of the corresponding projection 36 to the plane of surface 35 of the corresponding side panel 31. Upon rearward movement of body 26 relative to handle 13 of the gun, cam surfaces 42 engage generally vertical edges 44 formed on side walls 20 and 21 of the gun handle at the rear of their openings 22 to progressively cam side panels 31 of body 26 slightly apart against the resilience of the material of body 26 which tends to urge panels 31 toward one another and tightly against surfaces 32. Thus, projections 36 are deflected far enough apart to move out of openings 22 and past the rear portions of side walls 20 and 21 of the gun handle to enable complete disassembly of body 26 from the gun handle.

As seen in FIG. 9, the side panels 31 of body 26 of the grip assembly are shaped to cover most of the area of side surfaces 32 of the handle portion of the gun. The forward edge 45 of each side panel 31 may extend along a straight line inclined slightly forwardly as seen in FIG. 9 and aligned laterally with the similarly inclined forward edge 46 (FIG. 5) of the corresponding side surface 32 of the gun handle. At their lower entremities, side panels 31 of body 26 have horizontal bottom edges 47 aligned laterally with bottom edges 48 of the gun handle. The rear edges 49 of side panels 31 may curve gradually forwardly as they advance upwardly to a location 50, from which they may extend rearwardly to a location 51 defining an upper rearwardly projecting portion 52 of each side panel 31. At the location of its portion 52, each of the side panels 31 contains a shallow recess 53 within which a thin element 54 may be retained by adhesive. Element 54 preferably has a thin body 55 of deformable elastomeric material, such as neoprene, containing a circular opening or recess within which a medallion 56 is retained adhesively or by other means. The element 55 and its medallion 56 may carry the logo of a particular gun manufacturer, or another identifying or decorative design. The assembly may thus be easily adapted for use by different gun manufacturers or users.

The rearwardly projecting portion 40 of connector portion 131 of body 26 terminates downwardly at a location spaced above the plane of lower edges 47 of side panels 31. At the lower end of rear edge 49 of side panels 31, each of the side panels has a portion 57 which projects rearwardly and contains a cylindrical opening 58 centered about a transverse axis 59 extending perpendicular to vertical central plane 33 of the gun. Laterally between these portions 57 of the two side panels of body 26, the handle 13 of the gun has two rearwardly projecting portions 60 containing cylindrical openings 61 centered about axis 59. Pin 60 is cylindrical along most of its length and dimensioned to fit closely within openings 59 and 61 to secure body 26 on the gun handle and against removal therefrom or movement relative thereto.

Figure 4:
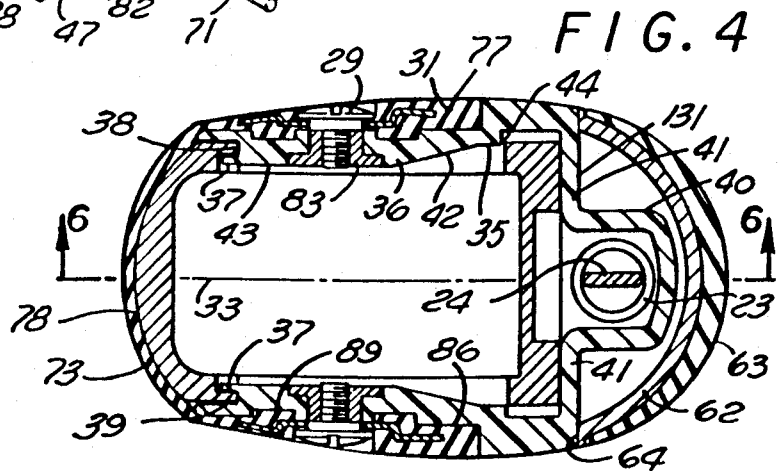
FIG. 4 is an enlarged horizontal section taken on line 4—4 of FIG. 1.
Figure 6:
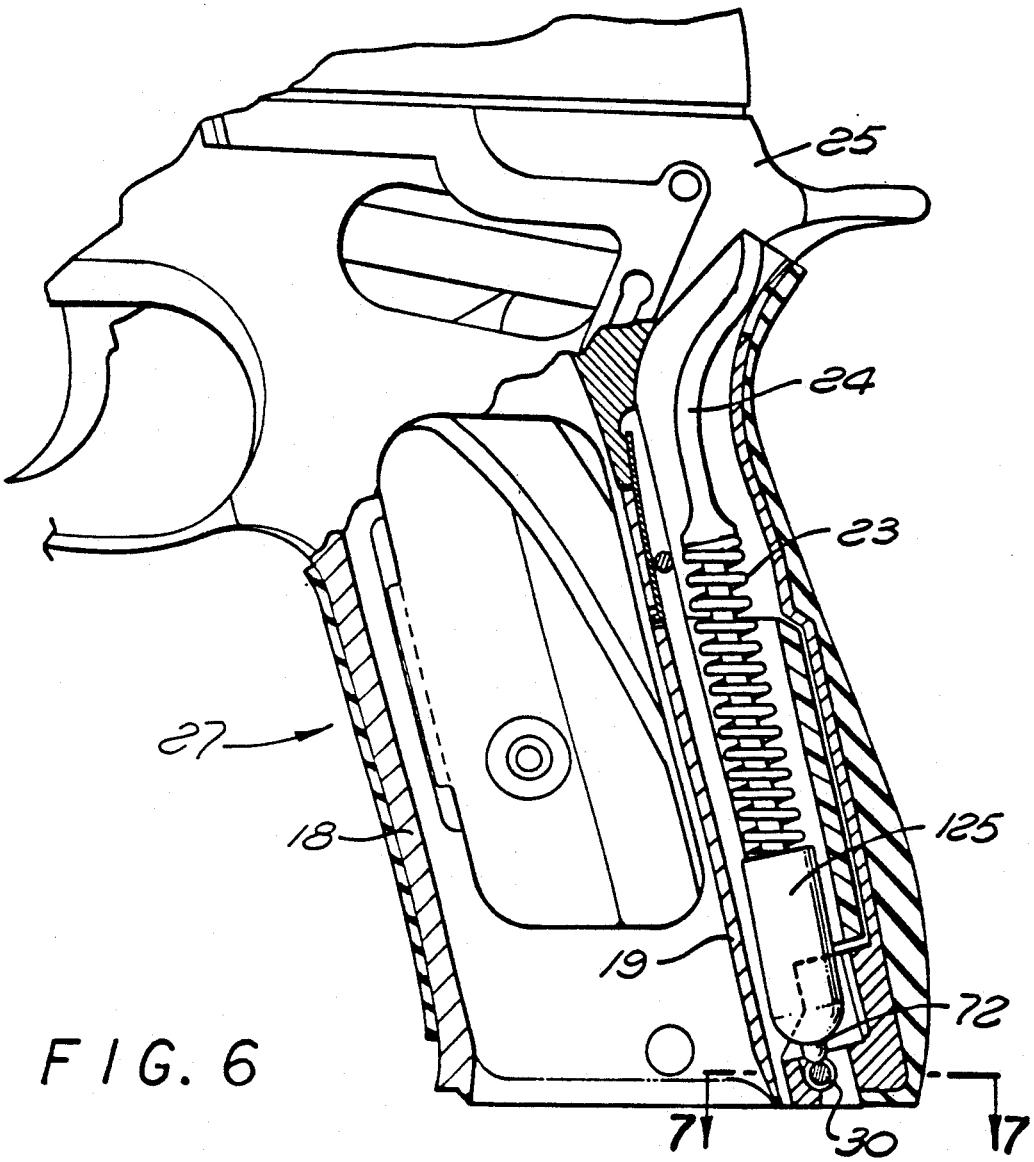
FIG. 6 is a central vertical section taken on line 6—6 of FIG. 4.
Figure 7:
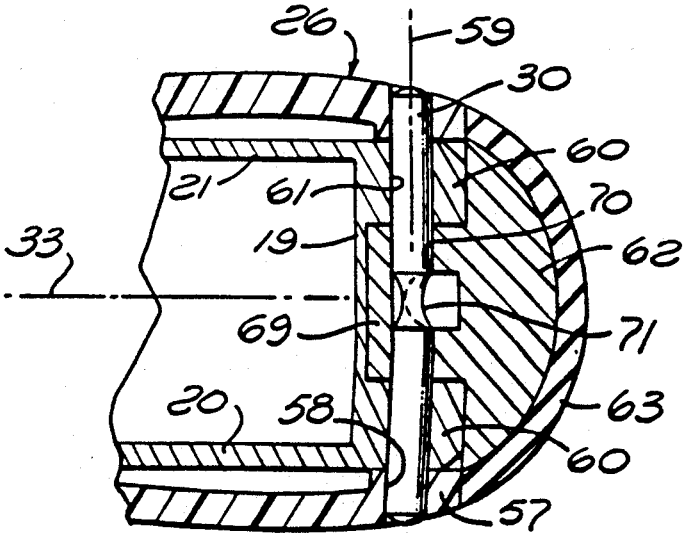
FIG. 7 is an enlarged fragmentary horizontal section taken on line 7—7 of FIG. 6.

Back strap 28 is attached to the rear of the gun behind body 26, and includes a rigid reinforcing element 62 curved as seen in FIG. 4 to extend about portion 40 of body 26 and about spring 23 and stirrup 24. Element 62 may be formed of an appropriate rigid metal cast to the illustrated shape, and covered over its entire rear surface with a deformable elastomeric material 63 adhered continuously to that rear surface of element 62. The material 63 is deformable when contacted by a user's hand to cushion such contact during handling and firing of the gun. The forward edges 64 of both of the portions 62 and 63 of back strap 28 are shaped to curve gradually forwardly as they advance upwardly, in correspondence with the curvature of rear edges 49 of the side panels 31 of body 26, to contact those edges 49 from their lower extremities to the location 50 of FIG. 1. Upwardly beyond point 50, edges 46 curve rearwardly at 66 in correspondence with the contacting edges of panels 31 and to the locations 51. At the location 67 of FIG. 1, the rigid element 62 of back strap 28 has a rearwardly and upwardly facing arcuate edge contacting an arcuate shoulder 68 formed on the frame of the gun to retain the upper portion of the back strap against rearward movement.

At its lower end, the metal of reinforcing element 62 has a lug 69 projecting forwardly between projections 60 of the gun handle and containing a cylindrical opening 70 within which pin 30 is received in closely fitting relation to secure the lower end of back strap 28 in rigidly fixed position relative to body 26 of the the grip assembly and handle 13 of the gun. At its center, pin 30 has an annular groove 71 within which a downwardly projecting end portion 72 of part 125 is received in a relation locking pin 30 in its assembled position within openings 58, 61 and 70.

The forward grip unit 27 of the assembly is molded of neoprene or other deformable elastomeric material to the configuration illustrated in FIG. 8. That figure shows grip unit 27 in a flattened condition to which it may initially be formed before it is wrapped around the forward end of the gun handle. Unit 27 is shaped to form two side panels 74 and 75 to be received at the outer sides of side panels 31 of body 26, with panels 74 and 75 being connected together by a cross strap portion 73 of element 27. Portions 73, 74 and 75 are molded integrally of neoprene or another resiliently deformable elastomeric material 77, with two rigid metal reinforcing plates 173 embedded within side panels 74 and 75. The elastomeric material 77 of grip unit 27 covers entirely the inner and outer surfaces of reinforcing plates 73, and extends beyond the edges of those plates to completely enclose them. The connector strap portion 73 of unit 27 extends and curves across the curving forward surface 78 of the gun handle to cover it. Thus, all of the surfaces of unit 27 which contact a user's hand are deformable to cushion that contact. Each of the reinforcing plates 173 may contain a number of apertures 273 so that the elastomeric material within which they are contained can extend through the apertures to increase the integrity of the overall unit.

Side panels 74 and 75 of unit 27 are shaped to fit within recesses 78 formed in side panels 31 of body 26. Each side panel 74 or 75 has a rear edge 79 which curves gradually forwardly as it advances upwardly, and which contacts a correspondingly curving edge 80 defining the back of the recess 78 within which the side panel is received. Similarly, a bottom horizontal edge 81 of each of the side panels 74 and 75 engages an edge 82 defining the bottom of the recess 78. Screws 29 extend through openings 129 in side panels 74 and 75, and connect threadedly to nut 83 rigidly carried by side panels 31 of body 27, to thus retain panels 74 and 75 tightly against panels 31 and in assembled relation relative thereto. The shanks of screws 29 may be close fits within the openings 129 in reinforcing plates 73, with the elastomeric material being recessed at the outer sides of the plates to allow the heads of the screws to bear against the plates about openings 129 and thus effectively clamp the plates inwardly toward side panels 31.

The outer surfaces of side panels 74 and 75 may be checkered as represented at 85, or otherwise irregularized to enhance the friction between a user's hand and the panels and thus facilitate control of the gun. At their inner sides, panels 74 and 75 have planar vertical surfaces 86 extending parallel to plane 33 and adapted to engage correspondingly parallel planar vertical surfaces 87 on the outer sides of body panels 31 when screws 29 are tightened. Extending about the locations of nuts 83, panels 31 contain shallow recesses 88 which may be essentially rectangular and vertically elongated as shown, and which receive similarly shaped shallow projections 89 formed on the inner surfaces of panels 74 and 75 and projecting inwardly beyond the planes of surfaces 86. Projections 89 thus fit closely within recesses 88 to coact with the screws 29 and edges 79 and 80 in holding forward grip unit 27 in fixed position relative to the other elements of the grip assembly.

To now describe the manner of application of grip assembly 10 of FIGS. 1 to 9 to the illustrated gun 11, a user first attaches body 26 to the gun handle by movement of body 26 forwardly from the broken line position of FIG. 9 to the full line position of that figure. As the body is moved forwardly from the broken line position of FIG. 9, the two side panels 31 of body 26 are forcibly held by the user in slightly spread condition, to be spaced far enough apart to allow the two panels 31 to move forwardly along opposite sides of the gun handle until they reach a position at which projections 36 at the inner sides of panels 31 can move into openings 22 in the sides of the gun handle. The resilience of connector portion 131 of body 26 then urges side panels 31 toward one another and against the opposite sides of the gun handle so that as body 26 is moved forwardly to the full line position of FIG. 9, portions 39 of the gun handle are received within grooves 38 in walls 31 to lock those walls against lateral separation. As will be understood, the portions of panels 31 defining the inner sides of groove 38 are engageable outwardly against portions 39 of the side walls of the gun handle to prevent movement of panels 31 laterally away from the gun handle.

Next, back strap 28 can be moved forwardly and upwardly to its FIG. 1 position about the rear of the gun handle, with engagement of shoulders 67 and 68 at the upper end of the back strap, after which pin 30 can be inserted into, the opening 58 in one of the side panels 31, then through the openings 61 and 70 in the gun handle and back strap, and finally through the opening 58 at the opposite side of body 26, to complete the connection of the back strap to body 26 and to the gun handle. The forward grip unit 27 may then be moved into position in front of the gun handle, after which side panels 74 and 75 may be wrapped rearwardly at opposite sides of body 26 and be secured thereto by screws 29.

Figure 10:
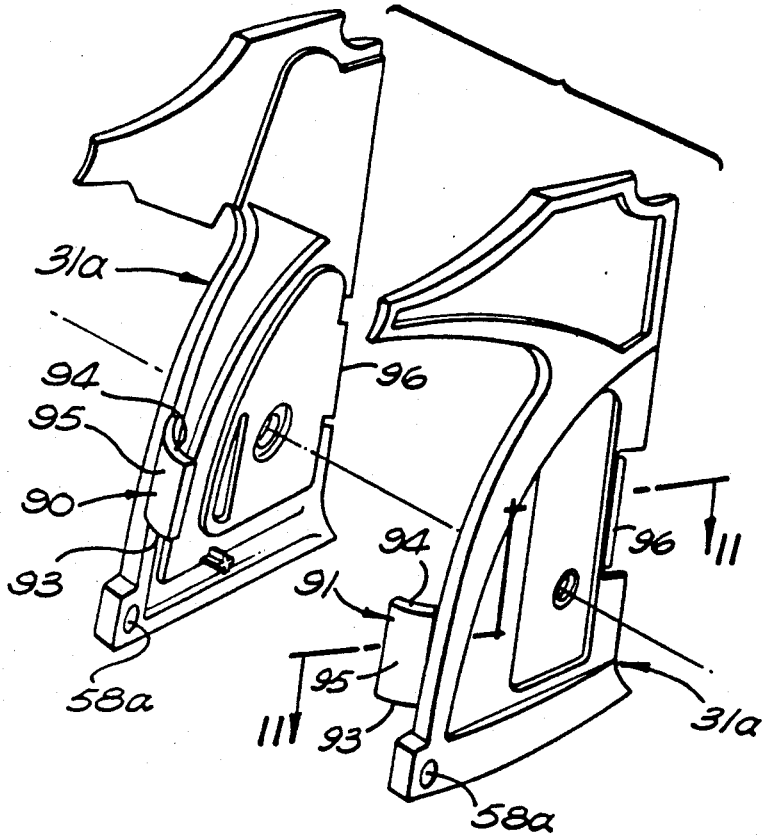
FIG. 10 is a perspective view showing a variational type of body structure for a grip assembly embodying the invention, with the two side panels of the body of FIG. 10 being formed separately rather than being integrally connected together as in FIGS. 1 to 9.
Figure 11:
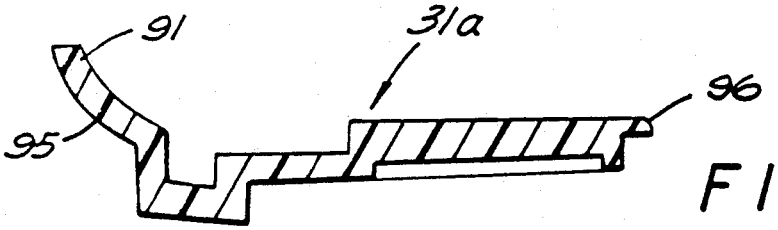
FIG. 11 is a horizontal section taken on line 11—11 of FIG. 10.
Figure 12:
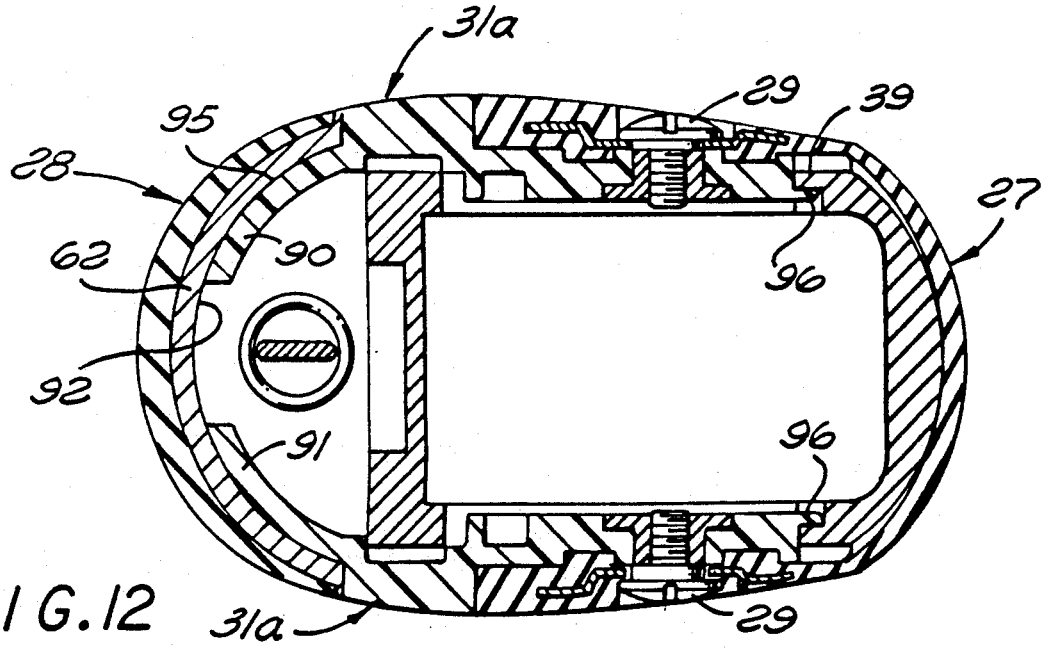
FIG. 12 is a horizontal section similar to FIG. 4 but showing the two piece variational body structure of FIG. 10.

In lieu of the integrally formed one piece body 26 of FIGS. 1 to 9, the body structure of a grip assembly embodying the invention may be formed of two separate side panels 31*a* as shown in FIGS. 10 to 12. These side panels 31*a* are not joined at their rear edges by the connector portion 131 of body 26, but instead have projections 90 and 91 extending rearwardly and laterally inwardly toward one another for engagement by back strap 28 in a relation holding the rear portions of side panels 31*a* against movement laterally apart and away from the opposite sides of the gun handle.

The forward grip element 27 and back strap 28 utilized with the two piece body structure of FIG. 10 are constructed the same as in FIGS. 1 to 9 and are secured to the gun handle and body structure in the same way. As seen in FIG. 12, the inner metal element 62 of back strap 28 has a forward surface 92 which is curved concavely in horizontal section as illustrated in FIG. 12. This concave curvature continues essentially as shown in FIG. 12 through the entire vertical extent of projections 90 and 91, from their lower edges 93 (see FIG. 10)

to their upper edges 94. Projections 90 and 91 are given a horizontal sectional curvature corresponding to that of surface 92 of element 62 of the back strap, so that the curved outer surfaces 95 of projections 90 and 91 engage curved surface 92 of element 62 over extended areas, in a relation enabling back strap 28 to effectively confine projections 90 and 91 and the connected side body panels 31*a* against movement laterally apart and away from the gun handle.

The forward portions of body panels 31*a* form thin edge portions 96 of those panels which correspond to and may be shaped the same as flanges 37 of the first form of the invention, to be received at the inner sides of portions 39 of the gun handle in a manner preventing movement of the forward edges of panels 31*a* laterally away from the gun handle. In FIGS. 10 to 12, the material forming the outer walls of grooves 38 of FIG. 4 is omitted in order to simplify molding of side panels 31*a* of the body structure.

Side panels 31*a* of the body arrangement of FIGS. 10 to 12 may be identical with side panels 31 of FIGS. 1 to 9 except with respect to the discussed changes relating to provision of the projections 90 and 91 at the back of the panels and the discussed deletion of the outer walls of grooves 38 at the front of the panels. Pin 30 extends through the side panels 31*a* and through back strap 28 and the gun handle in the same manner as in FIGS. 1 to 9, and the forward grip unit is attached to side panels 31*a* by screws 29 as in the first form of the invention.

In assembling the variational arrangement in which panels 31*a* of FIGS. 10 to 12 are employed instead of integral body 26, the two panels 31*a* may first be placed against opposite sides of the gun handle, after which back strap 28 may be moved forwardly into engagement with the side panels and the gun handle to the position illustrated in FIG. 12. Pin 30 is inserted horizontally through opening 58*a* in the side panels corresponding to openings 58 in body 26 of the first form of the invention, and through the aligned openings in back strap 28 and the gun handle to locate the side panels and back strap relative to one another and relative to the gun handle. In this condition, the side panels are retained against movement laterally away from the gun handle by the discussed interfitting engagement of rear projections 90 and 91 of the side panels with the back strap, and by engagement of portions 96 at the forward edges of the side panels against the inner sides of portions 39 of the gun handle. The forward grip unit 27 can then be attached to the side panels by screws 29 as in the first form of the invention.

Among other advantages, the sectional formation of the grip assemblies of the present invention makes it possible for provision of different shapes and sizes of forward grip units 27 and back straps 28 to be attached to the main body 26 of the device of FIGS. 1 through 9, or panels 31*a* of FIGS. 10 to 12, in order to permit an individual to custom design an overall configuration which may best fit his or her hand.

While certain specific embodiments of the present invention have been disclosed as typical, the invention is of course not limited to these particular forms, but rather is applicable broadly to all such variations as fall within the scope of the appended claims.

I claim:

1. A grip assembly for a gun having a downwardly projecting handle, comprising:

two body panels to be received at opposite sides of the handle; and a grip unit having two side portions to be received at outer sides of said two body panels respectively, and a forward portion receivable in front of the handle and extending between and interconnecting said side portions of the grip unit.

2. A grip assembly as recited in claim 1, including a back strap to be received at the rear of said handle and which is formed separately from said body panels and said grip unit.

3. A grip assembly as recited in claim 1, in which said side portions and said forward portion of the grip unit are formed at least in part of deformable elastomeric material.

4. A grip assembly as recited in claim 1, including fasteners adapted to extend through said side portions of the grip unit and be connected to said body panels to secure the grip unit thereto.

5. A grip assembly as recited in claim 1, in which said two body panels have vertical edges receivable at inner sides of vertical portions of said handle to locate said body panels relative to the handle.

6. A grip assembly as recited in claim 1, in which said body panels are formed as part of a unitary body structure having a connector portion integral with and extending between and interconnecting said two body panels.

7. A grip assembly as recited in claim 6, in which said connector portion of said unitary body structure extends between said body panels at the back of the handle.

8. A grip assembly as recited in claim 1, in which said side portions of the grip unit and formed in part of deformable elastomeric material containing reinforcing plates stiffer than said elastomeric material, and said forward portion of the grip unit is formed of deformable elastomeric material.

9. A grip assembly as recited in claim 8, including fasteners adapted to extend through said side portions of the grip unit and be connected to said body panels to secure the grip unit thereto.

10. A grip assembly as recited in claim 7, in which said two body panels have vertical edges receivable at inner sides of vertical portions of said handle to locate said body panels relative to the handle.

11. A grip assembly as recited in claim 10, in which said body panels are formed as part of a unitary body structure having a connector portion integral with and extending between said interconnecting said two body panels at the back of the handle.

12. A grip assembly for a gun having a downwardly projecting handle, comprising:

two side body panels to be received at opposite sides of the handle;

two grip panels to be detachably mounted at the outer sides of said two body panels respectively; and a back strap to be received at the back of said handle and which is formed separately from said body panels and said grip panels.

13. A grip assembly as recited in claim 12, in which said back strap is formed in part of deformable elastomeric material having a rear surface of such material engageable with a user's hand, said back strap containing a reinforcing element of more rigid material.

14. A grip assembly as recited in claim 12, in which said body panels are formed separately and are retained by said back strap against movement relatively apart.

15. A grip assembly as recited in claim 12, in which said two body panels are formed separately and are retained at rear edges thereof by said back strap against movement relatively apart, said body panels having forward edges receivable at inner sides of vertical portions of said handle to locate said forward edges relative to the handle.

16. A grip assembly as recited in claim 12, in which said grip panels are portions of a grip unit having a forward portion receivable in front of the handle and extending between and interconnecting said grip panels.

17. A grip assembly as recited in claim 16, in which said grip panels are formed in part of formable elastomeric material containing reinforcing plates stiffer than said elastomeric material, and said forward portion of the grip unit is formed at least in part of deformable elastomeric material.

18. A grip assembly as recited in claim 17, including fasteners extending through said grip panels and connected to said body panels to secure said grip panels thereto.

19. A grip assembly for a gun having a downwardly projecting handle, comprising:

two side body panels to be received at opposite sides of the handle;

two grip panels to be detachably mounted at the outer sides of said two body panels respectively; and fasteners detachably connected to said two body panels respectively and securing said grip panels thereto.

20. A grip assembly as recited in claim 19, in which said fasteners are threaded fasteners received within openings in said grip panels and connected threadedly to said two side body panels respectively.

21. A grip assembly for a gun having a downwardly projecting handle, comprising:

two side body panels to be received at opposite sides respectively of the handle; and an element formed separately from said body panels and adapted to be contacted by a user's hand in holding the gun;

said two body panels and said element containing transverse openings alignable with one another and with an opening in the handle, for reception of a pin locating the body panels and element relative to one another and relative to the handle.

22. A grip assembly as recited in claim 21, in which said element is a back strap received behind the handle.

23. A grip assembly as recited in claim 22, in which said back strap is formed in part of deformable elastomeric material having a rear surface of such material engageable with a user's hand, said back strap containing a reinforcing element of more rigid material.

24. A grip assembly as recited in claim 23, in which said reinforcing element has a projection extending forwardly from a lower portion thereof to a location between said two body panels and containing one of said transverse openings for reception of the pin.

25. A grip assembly for a gun having a downwardly projecting handle, comprising:

two body panels to be received at opposite sides respectively of the handle;

two grip panels to be received at outer sides of said body panels respectively and at least one of which only partially covers the corresponding body panel;

said grip panels having outer surfaces formed of a deformable elastomeric material for cushioning contact with a user's hand; and a decorative element formed separately from said body panels and from said grip panels and attached to an outer surface of at least one of said body panels at a location not covered by the corresponding grip panel, to be exposed for viewing from the exterior of the assembly.

26. A grip assembly as recited in claim 25, including a back strap located behind said handle.

27. A grip assembly as recited in claim 25, in which said grip panels are portions of a grip unit having a forward portion extending between and interconnecting said grip panels in front of the handle.

28. A grip assembly as recited in claim 27, including a back strap connected to said body panels and located behind said handle.

29. A grip assembly for a gun having a downwardly projecting handle, comprising:

two side body panels to be received at opposite sides of the handle; and a back strap to be received at the back of said handle and which is formed separately from said body panels;

said back strap having portions positioned to retain rear portions of said body panels against movement relatively apart.

30. A grip assembly as recited in claim 29, in which said body panels have projections at rear edges thereof extending rearwardly and toward one another and engageable with said portions of the back strap to retain the rear portions of the body panels against separating movement.

31. A grip assembly for a gun having a downwardly projecting handle, comprising:

two side body panels to be received at opposite sides of the handle;

two grip panels to be detachably mounted at the outer sides of said two body panels respectively; and a back strap formed separately from said body panels and said grip panels and adapted to be secured in fixed position relative thereto at the back of said handle;

said body panels and said back strap containing transverse openings alignable with one another and with an opening in and said back strap relative to one another and relative to the handle.

32. A grip assembly for a gun having a downwardly projecting handle, comprising:

two side body panels to be received at opposite sides of the handle;

two grip panels to be detachably mounted at the outer sides of said two body panels respectively;

a back strap formed separately from said body panels and said grip panels and adapted to be secured in fixed position relative thereto at the back of said handle;

said grip panels being portions of a grip unit having a forward portion receiving in front of the handle and extending between and interconnecting said grip panels;

said grip panels being formed in part of deformable elastomeric material containing reinforcing plates stiffer than said elastomeric material;

said forward portion of the grip unit being formed at least in part of deformable elastomeric material; and fasteners extending through said grip panels and connected to said body panels to secure said grip panels thereto;

said body panels and said back strap containing transverse openings alignable with one another and with an opening in the handle, for reception of a pin locating said body panels and back strap relative to one another and relative to the handle.

33. A grip assembly as recited in claim 32, in which said back strap is formed in part of deformable elastomeric material having a rear surface of such material engageable with a user's hand, said back strap containing a reinforcing element of more rigid material.

34. A grip assembly as recited in claim 33, in which said two body panels are formed separately and are retained at rear edges thereof by said back strap against movement relatively apart, said body panels having forward edges receivable at inner sides of vertical portions of said handle to locate said forward edges relative to the handle.

35. A grip assembly as recited in claim 33, in which said body panels are formed as part of a unitary body having a rear connector portion extending between and interconnecting said side body panels at the back of the handle.

36. A grip assembly for a gun having a downwardly projecting handle, comprising:

two side body panels to be received at opposite sides of the handle;

two grip panels to be detachably mounted at the outer sides of said two body panels respectively; and a back strap formed separately from said body panels and said grip panels and adapted to be secured in fixed position relative thereto at the back of said handle;

said body panels being formed as part of a unitary body having a rear connector portion extending between and interconnecting said side body panels at the back of the handle.

* * * * *